United States Patent [19]

Turner

[11] 3,997,979

[45] Dec. 21, 1976

[54] RODEO TRAINING DEVICE

[76] Inventor: Joe D. Turner, S. S. Box 157, Corrales, N. Mex. 87048

[22] Filed: Feb. 12, 1975

[21] Appl. No.: 549,277

[52] U.S. Cl. ..... 35/29 R; 272/30; 272/53.1

[51] Int. Cl.[2] ..... A63K 3/00

[58] Field of Search ..... 35/11 R, 12 C, 29 R, 35/29 A, 29 B, 29 C, 29 D, 29 E, 29 F; 272/30, 36, 53.1

[56] References Cited

UNITED STATES PATENTS

| | | | |
|---|---|---|---|
| 1,925,180 | 9/1933 | Eyerly | 272/36 UX |
| 2,843,380 | 7/1958 | Simon | 272/53.1 |
| 3,417,990 | 12/1968 | Marasco | 272/30 |
| 3,747,419 | 7/1973 | Horvath | 272/36 X |

FOREIGN PATENTS OR APPLICATIONS

| | | | |
|---|---|---|---|
| 688,538 | 3/1953 | United Kingdom | 272/53.1 |
| 742,592 | 12/1955 | United Kingdom | 272/53.1 |

*Primary Examiner*—Harland S. Skogquist
*Attorney, Agent, or Firm*—Joseph F. Brisebois; Walter Kruger

[57] ABSTRACT

A rodeo training device for training cowboys to ride rodeo animals such as bulls and wild horses. The device includes a rider support and mechanism to drive the rider support to simulate the bucking and/or spinning motions of a rodeo animal attempting to unseat its rider.

11 Claims, 8 Drawing Figures

RODEO TRAINING DEVICE

This invention relates to mechanical bucking devices which simulate the bucking or bucking and spinning motions of rodeo animals such as wild horses and bulls.

More specifically, the invention relates to a bucking device which can be used to train rodeo riders in the art of riding a wild horses or a bull.

Rodeos frequently include contests of skill such as wild horses riding and bull riding. In these events, the cowboy is judged by his ability to remain on the rodeo animal for at least a predetermined period of time.

A bucking wild horse has a characteristic up and down motion with perhaps some forward or transverse motion which the animal instinctively uses in an effort to unseat the rider. The horse does not normally spin or turn at a rate sufficient to affect the riders balance, the motion of the horse being primarily up and down.

In the case of the bull, there is a combined up and down as well as a spinning motion of the animal in an effort to unseat the rider. Some bulls turn in one direction, for example, to the right, whereas other bulls will turn in the opposite direction to the left.

In the judging of the contestants in wild horse riding and bull riding, the score awarded to the contestant is based in part on how difficult the selected animal is to ride for the required period of time.

In the past it has been necessary for cowboys for wild horse riding and bull riding rodeo contests to train on live animals. This has substantially limited the training available for many potential contestants since rodeo horses and bulls are normally not available merely for training, because it is quite expensive to maintain such animals. Even where a bull or a rodeo horse, or both are available for training, the rider can only obtain the benefit of the bucking, and bucking and spinning characteristics of the available animals, and frequently finds it difficult to ride animals which buck or buck and spin at a different speed from, or which spin in a different direction from the animals available for training.

Correspondingly, there has been a need for a rodeo training device which simulates the action of a wild horse and/or the action of a bull attempting to unseat a rider, to train cowboys for rodeo events. In accordance with this invention, such a device is provided.

In accordance with this invention there is provided a mechanical device which can be used for either bucking, without spinning, or which can be used for both bucking and spinning simultaneously to simulate the action of either a wild horse or a bull attempting to unseat a rider.

Further, in accordance with this invention, there is provided a mechanical device in which the rate of bucking as well as the rate of spinning can be changed to assist training a novice in the art of wild horse and/or bull riding, and which can also be adjusted to simulate the bucking and/or spinning characteristics of several known rodeo animals, so an experienced cowboy entered to participate in a rodeo event, can train for riding the rodeo animals which he will be selected to ride at that rodeo.

In accordance with this invention, the cowboy can adjust the training device to simulate known characteristics of particular wild horses and/or bulls used at particular rodeos. Correspondingly, the device of this invention permits the cowboy to train, not only in the general art of wild horse and bull riding, but also permits him to train for riding rodeo animals with particular bucking and/or spinning characteristics, and with the spinning selective in either direction, so that previously observed motions of a particular animal in attempting to unseat the rider can be closely simulated.

Such features and advantages of the invention are provided by a rider support, which simulates the back of a bull, and to which a saddle can be attached, the rider support being power driven to provide an up and down bucking motion, and the rider support also being power driven to spin about a vertical axis, with controls to permit changing the rate of the up and down bucking motion, the rate of spin, and the direction of spin.

Correspondingly, an object of this invention is a mechanical device, useful for training cowboys for rodeo riding events, in which the characteristics of the motions of rodeo animals attempting to unseat their riders can be closely simulated, to enable the cowboys to attain expertise in such events.

Another object is a bucking and spinning device, useful for training cowboys for rodeo events, in which the rate of bucking, the rate of spinning, and the direction of spinning can be selectively changed.

A further object is a training device in which the rate of bucking can be changed, the rate of spinning can be changed, the direction of spinning can be changed, these changes being independently selectable, and in which the spinning can be disabled, if desired so the device provides only a bucking action.

An additional object is a device according to one or more of the objects set forth above in which the device is rugged, durable, reliable, and far more safe than attempting to train on live animals of the kind used in rodeos.

Numerous other objects, features, and advantages will become apparent with reference to the accompanying drawings which form a part of this specification, and in which FIG. 1 is a pictorial view of the rodeo training device as seen at an angle from the front;

Figure 1:
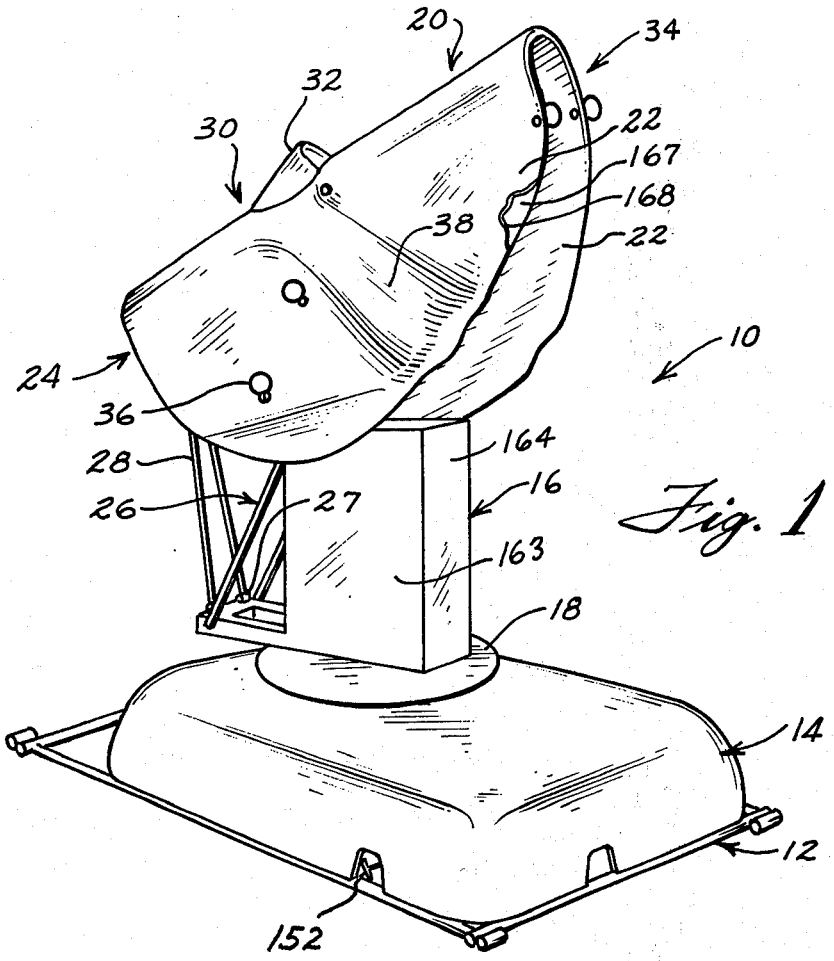

Referring now to the drawings and particularly to FIG. 1, the rider training device according to this invention is shown. Training device 10 includes a base 12 adapted to rest on and be secured to a horizontal surface, cover 14 being provided to enclose the base and the components mounted thereon. Extending upwardly through an opening in the base is a rectangular housing 16, and fitted to the housing adjacent the base cover opening is a rotary seal 18 of flexible material which resists the entry of dust and water to the inside of cover 14.

Mounted on housing 16 is a rider support 20 with sloping sides 22 and which diverges in a direction toward its rearward end 24 so rider support 20 simulates the torso of a rodeo animal such as a bull. Housing 16 includes a generally triangular framework 26 which projects in a direction toward and is beneath the rearward end 24 of rider support 20. Pivotally connected to the rigid framework 26 at pivots 27 are a pair of support struts 28 the upper ends of which are pivotally connected to rider support 20 by pins 29 (FIG. 5) adjacent rearward end 24 of the support. The rider sits generally in the area designated 30 which is provided with a horn or protuberance 32 which prevents sliding of the rider (or a saddle when used), toward the forward end 34 of the rider support. Suitable connectors such as D-rings 36 are secured to various parts of the rider support to provide for connecting ropes, simulated reins, and a saddle to the support when needed.

Padded elongated shoulders 38 are provided along the sides of the rider support. These shoulders 38 slope toward the front of the body, and simulate for the rider, the shoulders of an animal such as a bull used in rodeo events.

As will soon be described in detail, the motion of rider support 20 is a generally oscillating up and down motion of the forward end 34 of the body about the pivot connection 29 at the rearward end 24 of the body with support struts 28, and a crank mechanism at housing 16 which lifts and lowers the rider support 20. The crank and struts cooperate to provide an oscillating fore and aft movement of the rider support 20 in addition to an up and down movement so that the action of a bucking wild horse or bull is closely simulated. In addition, housing 16 and rider support 20 can be rotated about a vertical axis so that the bucking and spinning action of a rodeo bull can also be simulated for rider training purposes.

The drive for imparting bucking motion to rider support 20 is a change speed drive so the rate of bucking can be adjusted. In addition, the drive which rotates housing 16 and rider support 20 is a change speed drive so the speed at which the housing and rider support revolve or spin can also be adjusted. Advantageously, the drives are reversible so that the bucking action can be from back to front as well as front to back, and the rider support 20 can spin either to the right or to the left thereby simulating the action of a desired rodeo animal.

Figure 3:
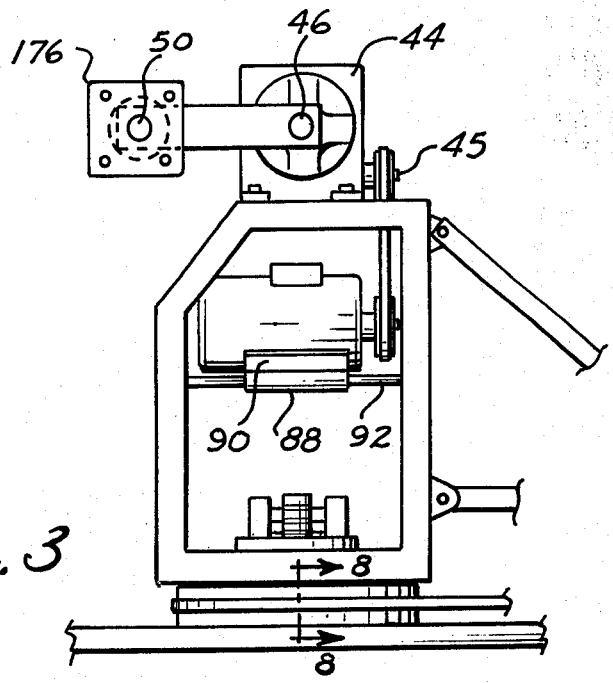
FIG. 3 is a partial side view in elevation looking along lines 3—3 of FIG. 2.
Figure 2:
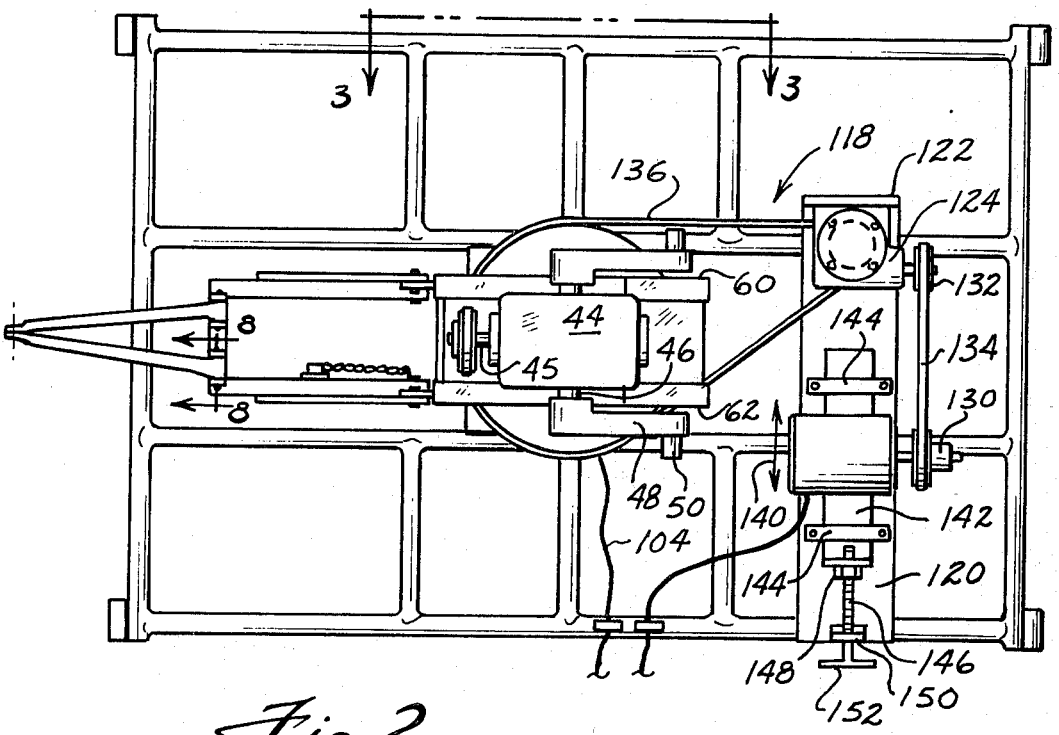
FIG. 2 is a top plan view of the training device with the rider support and base cover removed for purposes of explanation.
Figure 4:
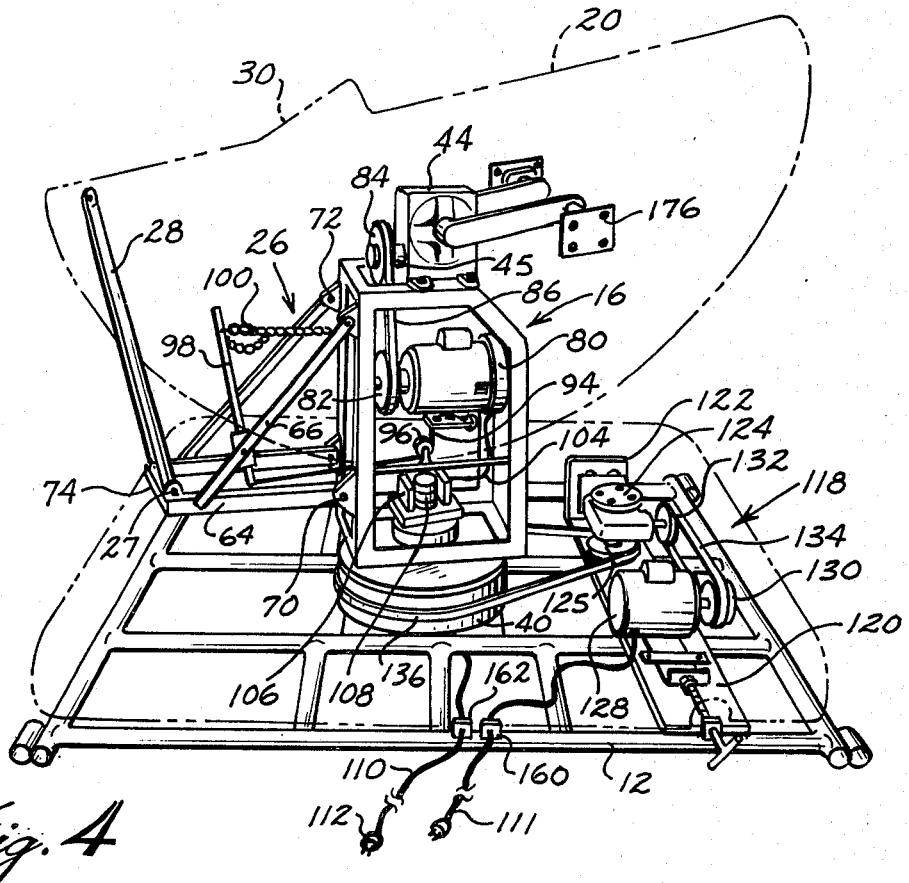
FIG. 4 is a pictorial side view showing other details of the training device and the relationship of the rider support to the mechanism of the device.
Figure 7:
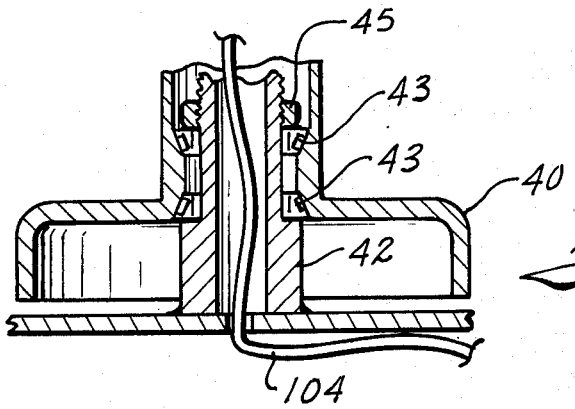
FIG. 7 is an enlarged partial view in section taken along line 7—7 of FIG. 3 and showing the bearing arrangement for mounting the drum which supports the mechanism housing.

FIG. 2 shows the device with base cover 14 and rider support 20 removed. As shown at FIG. 2, base 12 takes the form of a structural grid work which is preferrably fabricated from iron pipe, by welding, but which can be formed from other structural material of any desired cross-sectional configuration. As shown at FIGS. 2–4, housing 16 is secured to a drum 40. As shown at FIG. 7, drum 40 is mounted for rotation on a spindle 42 secured to base 12. Suitable thrust bearings 43 are provided between drum 40 and spindle 42 to support the weight of the housing, rider support, and rider for rotation, and nut 45 holds the drum 40 on the spindle.

Housing 16 is fabricated from structural material such as angle iron to provide the generally rectangular framework shown at FIGS. 2–4. Secured to the top of the housing is a right angle drive reduction gear unit 44 having an input shaft 45, and a double ended output shaft 46. A crank arm 48 is keyed to each end of the output shaft. Secured to each crank arm 48 is a crank pin 50 which projects outwardly with respect to reduction drive 44. The distance between the inside surfaces of the crank arms is only slightly greater than the width of housing 16 as measured between its sides 60 and 62. There is, however, sufficient clearance for crank arms 48 to rotate without interference with shaft 46 of the reduction drive 44.

Brace structure 26 takes the form of horizontal arms 64 (FIG. 4) secured to legs 66 projecting at an acute angle from the arms and secured to the arms by welding. Arms 64 and legs 66 are each secured to housing 16, by bolts 70 and 72 respectively. A horizontal brace 74 extends between the ends arms 64 and is secured to the arms, for example, by welding. Support struts 28 are pivotally connected to brace 74 by shaft 27 which extends through bosses 78 at the lower ends of the struts.

Reduction gear 44 is driven by an electric motor 80 mounted in housing 16. Connected to the drive shaft of motor 80 is a spring loaded variable speed pulley 82 which drives pulley 84, keyed to the input shaft 45 of the reduction gear, via a V-belt 86.

Motor 80 has a horizontal sleeve 88 (FIG. 3) secured to its base 90 at a location off set to one side of the base, but parallel with the axis of the motor shaft. A support shaft 92, secured to housing 16 extends through sleeve 88 so one side of the motor is pivotally supported on the shaft 92. V-belt 86 supports some of the weight of the motor. The spring characteristics of variable speed pulley 82 are so selected with respect to the weight of motor 80 that pulley 82 can close against the weight of the motor to lift the motor. Closing of the pulley increases the linear speed of belt 86, and correspondingly, the rate of bucking increases.

Connected to base 90 of the motor at the other side of its center line from sleeve 88 is a cable 94 which extends around a pulley 96 secured to the housing. A lever 98 pivoted to leg 66 is connected to the end of cable 94 and provides for pivoting the motor downwardly to decrease the effective diameter of pulley 82 (to decrease the bucking speed) when the upper end of the lever is pushed toward housing 16, or permitting the motor to pivot upwardly when the lever is pulled, in response to the spring action of the pulley. A chain 100 or other suitable securing device for the upper end of the lever is provided to maintain the lever in the position to which it is manually set, against the upward pull exerted on this lever by the spring of variable speed pulley 82. Since the cable 94 permits the motor to pivot downwardly at anytime, a heavy drive load on the motor will cause the pulley to open and ride in the smallest diameter of the pulley until the load is reduced. This action reduces strain on the motor, for example, when the motor is started with a rider on the rider support.

It is to be appreciated that for economy, stepped pulleys could be used in lieu of variable speed pulley 82 and reduction gear pulley 84 to provide only several speeds of rotation of crank 48 rather than the variable speed arrangement shown in the preferred embodiment.

Electrical current to power bucking drive motor 80 is provided via a cable 104 electrically connected between rotary brush assembly 106 and motor 80. Brush assembly 106 is secured to housing 16 and rotates with the housing and drum 40. A slip-ring assembly 108 is secured to the upper end of stationary spindle 42. Current is supplied to the slip-ring assembly from an electrical cable 110 which extends through the inside of the spindle and has a plug 112 for connection to an electrical receptacle.

Drum 40, housing 16, and rider support 20 are rotated as a unit by a drive assembly 118 (FIGS. 2 and 4). Drive assembly 118 is mounted on a support plate 120 secured to base 12. Support plate 120 has an upwardly bent end portion 122 to which a reduction gear 124 is secured so a pulley 125 keyed to its vertical output shaft is in a plane which includes drive face 127 of drum 40. Reduction gear 124 is driven by an electrical motor 128 which has a variable speed pulley 130 keyed to its shaft. The reduction gear input shaft has a pulley 132 keyed to it, and pulley 132 is coupled to variable speed pulley 130 by a V-belt 134. Extending around output pulley 126 and drum 40 is a V-belt 136.

Motor 128 is mounted on support 120 for adjustment in the direction of arrows 140. Such adjustment is provided by mounting the motor on a plate 142 guided by hold-down straps 144 which permit the motor and plate 142 to be moved in a direction toward and away from reduction gear 124. A threaded adjusting screw 146 is threaded into a threaded bushing 148 secured to motor support plate 142. Screw 146 is journaled in a bracket 150 which mounts the screw for rotation in response to the turning of handle 152 but which prevents axial movement of the screw.

To increase the speed of output pulley 126 of gear reduction unit 124, (and thus increase the rate of spinning) screw 146 is rotated in a direction to move motor 128 toward the gear reduction unit. This permits drive belt 134 to ride in a larger effective diameter of variable pulley 130 as a result of the spring action of the pulley which forces the drive belt outwardly as the tension in the belt decreases. To decrease the speed of the gear unit output pulley 126 and correspondingly decrease the speed at which rider support 20 spins or rotates, screw 146 is turned to move motor 128 away from reduction gear unit 124 to the V-belt 134 forces the pulley flanges apart to decrease the pulley diameter.

By virtue of this arrangement, speed variation within reasonable limits can be selectively obtained for the spinning movement of the training device.

Advantageously, a reversing switch 160 is provided in the wiring of motor 128, which can be a capacitor start motor. Reversing switch 160 can be of the well known manually operated drum type having forward, off, and reverse positions. Switch 160 selectively controls the spin direction of the housing 16 and rider support 20. A reversing switch 162 (like switch 160) can be provided in cable 110, which provides electrical current to bucking motor 80 via the brush and slip-ring assemblies 106 and 108. Rotation of motor 80 in either of two directions provides for two forms of bucking action, one different from the other, so the cowboy can experience different bucking actions.

Figure 6:
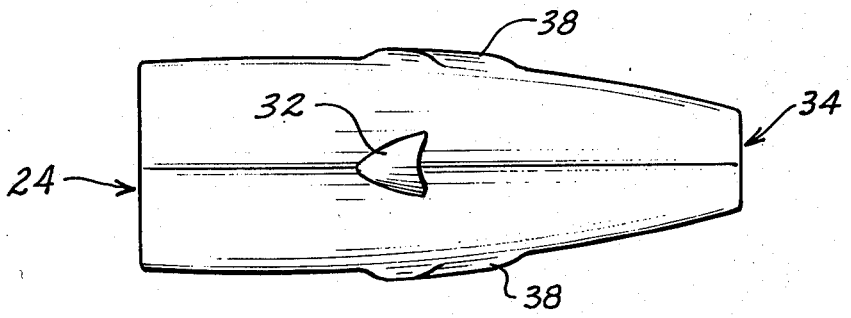
FIG. 6 is a top plan view of the rider support.

Side and end cover plates 163, 164 (FIG. 1) are secured to the framework of housing 16 to enclose the various components mounted in this housing. These plates can be removable to facilitate servicing and inspection of the components within the housing. Rider support 20 is formed from heavy guage sheet metal 167 bent to the generally inverted U-shaped configuration shown at FIGS. 1 and 5. The sheet metal is covered with a sheet 168 of heavy durable material such as single ply rubber belting which is cemented to the sheet metal and presents an attractive appearance. Shoulders 38 take the form of padding between cover sheet 168 and sheet metal 167, and simulate the shoulders of a rodeo animal such as a bull. As is apparent from FIGS. 1 and 6, these shoulders slope downwardly and forwardly at an angle of about 45° from the area 30 where the rider sits. The rider support 20 diverges uniformly from forward end 34 to rearward end 24, as shown at FIG. 5.

The rider support 20 is suitably reinforced and braced for rigidity, and strength, especially in the regions where mechanical connections are made, such as at bearing blocks 176 and at the connections between pivot pin support strap 31 (FIG. 5) and the rearward end of body 20. A cross brace 170, of pipe, can be secured between the sides of the rider support as shown at FIG. 5.

Figure 5:
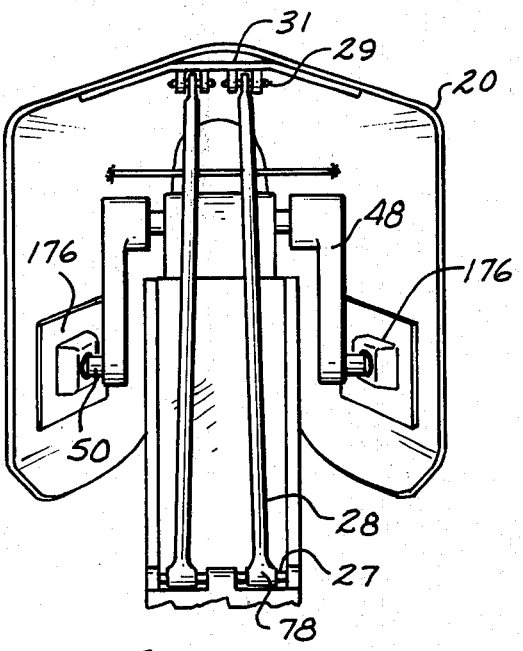
FIG. 5 is a rear view of the training device.

FIG. 5 shows the manner in which rider support 20 is connected to housing 16 for oscillating movement. Crank pins 50 at the ends of the respective crank arms 48 extend into bearing blocks 176 which are bolted to the sheet metal from which rider support 20 is formed. The sheet metal where the bearing blocks are secured is reinforced with plates 178. Bearing blocks 176 each contain self-aligning bearings into which the crank pins 50 extend. As can be seen from FIG. 4, the bearing blocks 176 are secured to rider support 20 at a location forward of the area 30 where the rider sits so the bucking action is felt by the rider as if it originated along the shoulders 38.

Figure 8:
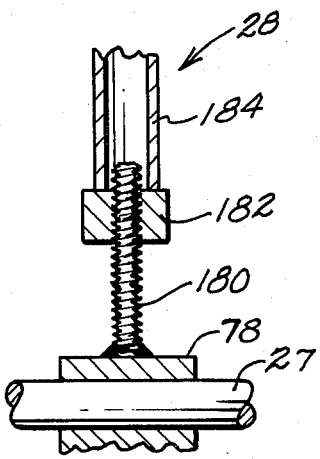
FIG. 8 is an enlarged view in section taken along line 8—8 of FIG. 2, and shows a modification.

Support struts 28 can be of adjustable length. As shown at FIG. 8, a threaded rod 180 can be welded to boss 78 through which shaft 27 extends, and which is at the lower end of support strut 28. In this embodiment, a nut or threaded sleeve 182 is welded to the lower end of the section of pipe 184 which forms the body of the strut. Since the length of the strut controls the height of the rearward end 24 of rider support 20, lengthening or shortening the struts has the effect of varying the motion transmitted to the rider support by rotation of crank arms 48. Correspondingly, the adjustable struts provide another adjustment feature which enables selectively changing the motion of the rider support. Adjustment of the length of the struts, where the connection shown at FIG. 8 is used, is accomplished by removing the pin 29 from the upper end of the strut, and rotating pipe section 184 until the desired length is obtained. The upper end of the strut is then re-pinned to connect the strut to rider support 20 and prevent rotation of the strut so its length cannot change.

Operation

Where training device 10 is used for the first time, the plugs or cables 110 and 111 are plugged into suitable electrical receptacles, and drum switches 160 and 162 are operated in their forward and reverse positions to check the operation of the device. If a rider is using the training device for the first time, the upper end of lever 98 is pushed inwardly toward the housing to its innermost position to provide the slowest speed of bucking and the lever is secured in this position with chain 100. Screw 146 is adjusted to move motor 128 to its furthest position away from gear reduction unit 124, to provide the slowest spin speed for the training device.

The rider then seats himself on the rider support in the general region designated 30, and an assistant can then operate switch 162 to commence the bucking action. Then, the assistant can operate switch 160, to cause rider support 20 to spin in a desired direction. To reverse the direction of spin, switch 160 is first moved to the off position until the spinning motion stops, and is then reversed so the rider support spins in the opposite direction. Switch 162 can also be reversed to provide a front to back as well as a back to front oscillating or jumping action.

As additional experience is acquired, and the rider becomes more proficient, the upper end of lever 98 is moved further away from the housing and is re-chained in the new position, to increase the rate of the bucking or jumping action. To increase the speed of spin, screw 146 is turned to move the motor toward gear reduction unit 124.

The training device 10 herein described can be adjusted to buck or jump at any desired speed in the range of 40–80 jumps per minute by changing the position of lever 98. The device can be adjusted to spin in either direction at speeds in the range of 15–35 revolutions per minute by adjusting screw 146. Tests have shown that bucking and spinning in the specified ranges provides excellent training for the beginner as well as the experienced rodeo cowboy.

While a preferred embodiment has been shown and described, it is to be understood that numerous changes can be made without departing from the intended scope of this invention, as set forth herein, and specified in the appended claims.

What is claimed is:

1. A rodeo training device comprising, in combination a base;

a rider support;

motor driven means supported by said base for imparting an up and down motion to the rider support to simulate a bucking action of a rodeo animal attempting to unseat its rider; and motor driven means supported by said base for spinning said rider support at a speed to simulate the spinning action of a rodeo animal attempting to unseat its rider.

2. A training device according to claim 1 which further includes mounting means mounting said motor driven means for imparting up and down motion to said rider support on said motor driven means for spinning said rider support.

3. A training device according to claim 1 wherein said motor driven means for imparting up and down motion to said rider support includes means for changing the rate of up and down motion of the rider support.

4. A training device according to claim 1 wherein said motor driven means for spinning said rider support includes means for changing the spin speed of the rider support.

5. A training device according to claim 1 where said rider support includes a body simulating a portion of the torso of a rodeo animal; and a protuberance on each side of the rider support simulating the shoulders of a rodeo animal.

6. A training device according to claim 5 wherein said simulated shoulders extend at an angle of approximately 45° with respect to the position of a rider on the rider support.

7. A training device according to claim 1 wherein said motor driven means for imparting up and down motion to said rider support includes means for imparting such up and down motion at a rate in the range of 40–80 up and down motions per minute;

said motor driven means for spinning said rider support includes means for spinning the rider support at a rate in the range of 15–35 revolutions per minute; and means for changing the direction of spin of the rider support.

8. A training device according to claim 7 wherein said motor driven means for imparting up and down motion to said rider support further includes means for changing the rate of the up and down motions; said motor driven means for spinning said rider support further includes means for changing the rate of spinning of the rider support.

9. A rodeo training device comprising a base;

a rider support;

motor driven means supported by said base for imparting an up and down motion to the rider support at a rate in the range of 40–80 up and down motions per minute to simulate a bucking action of a rodeo animal attempting to unseat its rider; and motor driven means supported by said base for rotating said rider support at a speed in the range of 15–35 revolutions per minute to simulate the spinning action of a rodeo animal attempting to unseat its rider.

10. A rodeo training device according to claim 9 wherein said motor driven means for imparting up and down motion of the rider support further comprises variable speed means for changing the rate of said up and down motion; and said motor driven means for rotating said rider support further comprises variable speed means for changing the speed of rotation of the rider support.

11. A training device according to claim 10 wherein said motor driven means for rotating said rider support further comprises means for rotating said housing in either direction, and means for selecting the direction of rotation.

* * * * *